United States Patent [19]

Parazader

[11] 4,313,383

[45] Feb. 2, 1982

[54] GUIDEWAY UNITS FOR ELEVATED GUIDEWAYS

[76] Inventor: Stephen Parazader, 44 Oak Ave., Dundas, Ontario, Canada, L9H 4Y9

[21] Appl. No.: 87,612

[22] Filed: Oct. 23, 1979

[51] Int. Cl.[3] ..... E01B 25/08

[52] U.S. Cl. ..... 104/124; 52/174; 52/724; 104/118; 104/125

[58] Field of Search ..... 104/118, 119, 124, 125; 105/141, 144; 238/5, 7, 87, 95, 98; 52/174, 381, 382, 724

[56] References Cited

U.S. PATENT DOCUMENTS

| | | | |
|---|---|---|---|
| 379,399 | 3/1888 | Jacobs | 238/98 X |
| 527,430 | 10/1894 | Knights | 52/174 X |
| 633,252 | 9/1899 | Venezia | 52/382 |
| 741,289 | 10/1903 | Union | 52/382 X |
| 1,101,767 | 6/1914 | Walker | 52/382 |
| 1,407,772 | 2/1922 | Roof | 52/174 X |
| 2,731,824 | 1/1956 | Hadley | 52/724 X |
| 3,343,320 | 9/1967 | Krajcinovic | 52/174 X |
| 3,566,557 | 3/1971 | Comolli | 52/174 X |
| 4,098,036 | 7/1978 | Spöler et al. | 52/73 X |

FOREIGN PATENT DOCUMENTS

| | | | |
|---|---|---|---|
| 167418 | 5/1954 | Australia | 104/118 |
| 17440 | 6/1913 | Denmark | 52/174 |
| 615639 | 8/1935 | Fed. Rep. of Germany | 238/87 |

*Primary Examiner*—Randolph A. Reese

*Attorney, Agent, or Firm*—Hirons, Rogers & Scott

[57] ABSTRACT

A guideway for use for example as an elevated roadway is constructed by forming guideway units comprising a massive elongated metal channel having one or a plurality, usually at least three, tubular metal tension void members running lengthwise down its interior and connected to its inside walls along its entire length. The void forming members are connected to the channel walls via longitudinal web members. Transverse shear connectors may also be provided above the void-forming members. The ends of the channel are closed and after hoisting each unit into position on spaced supports which engage beneath its ends it is filled with settable material, usually concrete, which encloses the tubular members to form a composite structure. The side walls preferably are inclined inward between a bottom sheet and the top vertical portions of the side sheets to give an aesthetic appearance, provide streamlining and reduced unwanted dead weight.

9 Claims, 10 Drawing Figures

GUIDEWAY UNITS FOR ELEVATED GUIDEWAYS

FIELD OF THE INVENTION

The present invention is concerned with improvements in or relating to guideway units for use in elevated guideways adapted, for example, to receive a mass transit railway line.

REVIEW OF THE PRIOR ART

With increasing urbanization and energy costs provision for economical rapid transit have become of considerable interest. There has always been a problem with the provision of rapid transit through densely populated areas that the high cost of acquisition of the land tends to make such proposals uneconomic. One solution that has been used extensively is to provide an elevated structure on which the rapid transit car can run, the structure being supported by pillars or frames that occupy very little of the space over which the roadway passes. The guideway units may in some of their aspects be regarded as a development of the floor structure described and claimed in my U.S. Pat. No. 3,894,370 issued July 16th, 1975.

DEFINITION OF THE INVENTION

It is an object of the invention to provide a new form of guideway unit for use in the construction of an elevated guideway.

It is another object of the present invention to provide a new form of elevated guideway for use, for example, as such an elevated structure.

In accordance with the present invention there is provided a guideway unit for use in combination with a settable material in the construction of an elevated guideway, the unit comprising:

an elongated closed end watertight metal channel constituted by a bottom metal wall member, spaced side metal wall members, and end metal wall members closing the respective ends of the channel for the retention of the settable material therein, the said channel having respective interior walls provided by the said wall members;

at least one elongated metal hollow tubular void-forming member extending the length of the channel in the interior thereof and connected at its respective ends to the end metal wall members so as to constitute longitudinal reinforcement for the channel, each hollow void-forming member being spaced from the channel interior walls and being connected to a channel interior wall along its length by at least one longitudinal web member fastened to the tubular member external wall and to the respective channel interior wall;

and set settable material filling the metal channel and surrounding each hollow void-forming member and the respective longitudinal web member so as to enclose them, the metal channel constituting permanent formwork for the settable material and together with the set settable material constituting a composite slab with composite action between the channel and the set settable material, the metal tubular void-forming members providing tension reinforcement for the composite slab, and the set settable material having an upper surface capable of providing or supporting a roadway for vehicles moving on the guideway.

DESCRIPTION OF THE DRAWINGS

Guideway units and elevated guideways that are particular preferred embodiments of the invention will now be described, by way of example, with reference to the accompanying diagrammatic drawings, wherein.

DESCRIPTION OF THE PREFERRED EMBODIMENTS

Figure 1:
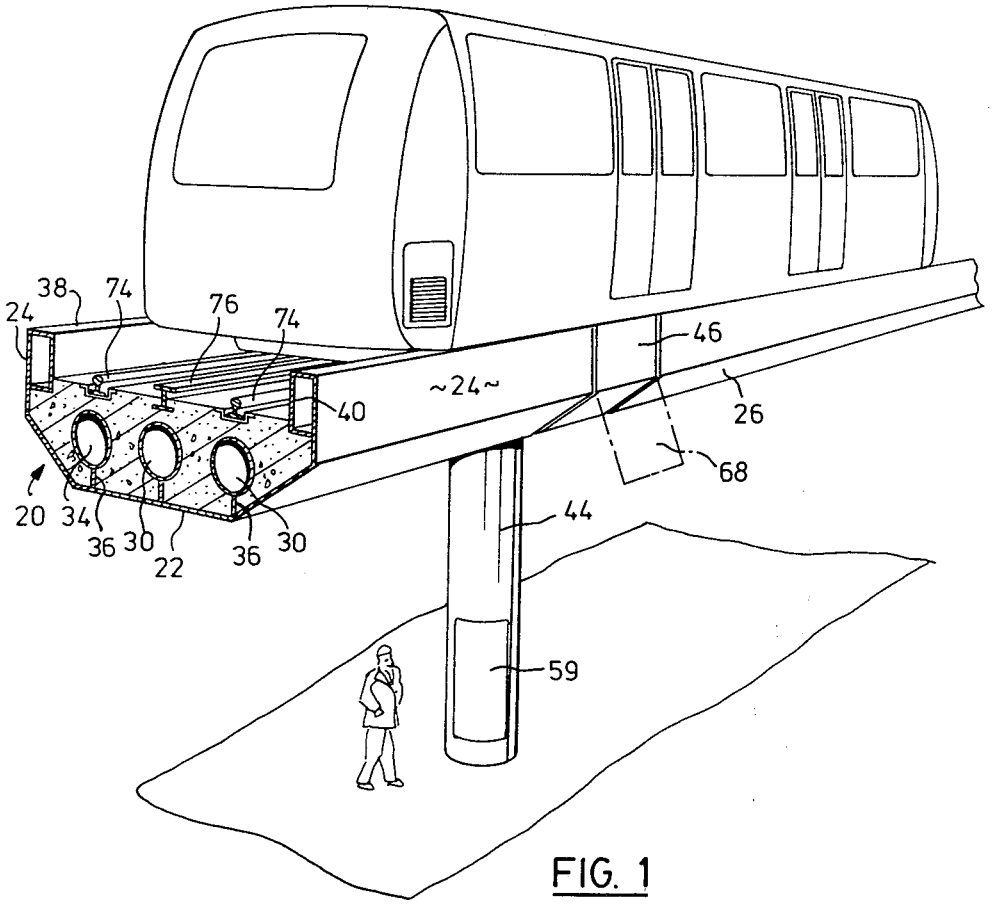
FIG. 1 is a perspective view of a first embodiment taken from one side of a single track elevated guideway, the guideway being shown cut off at one end to show its internal construction.
Figure 2:
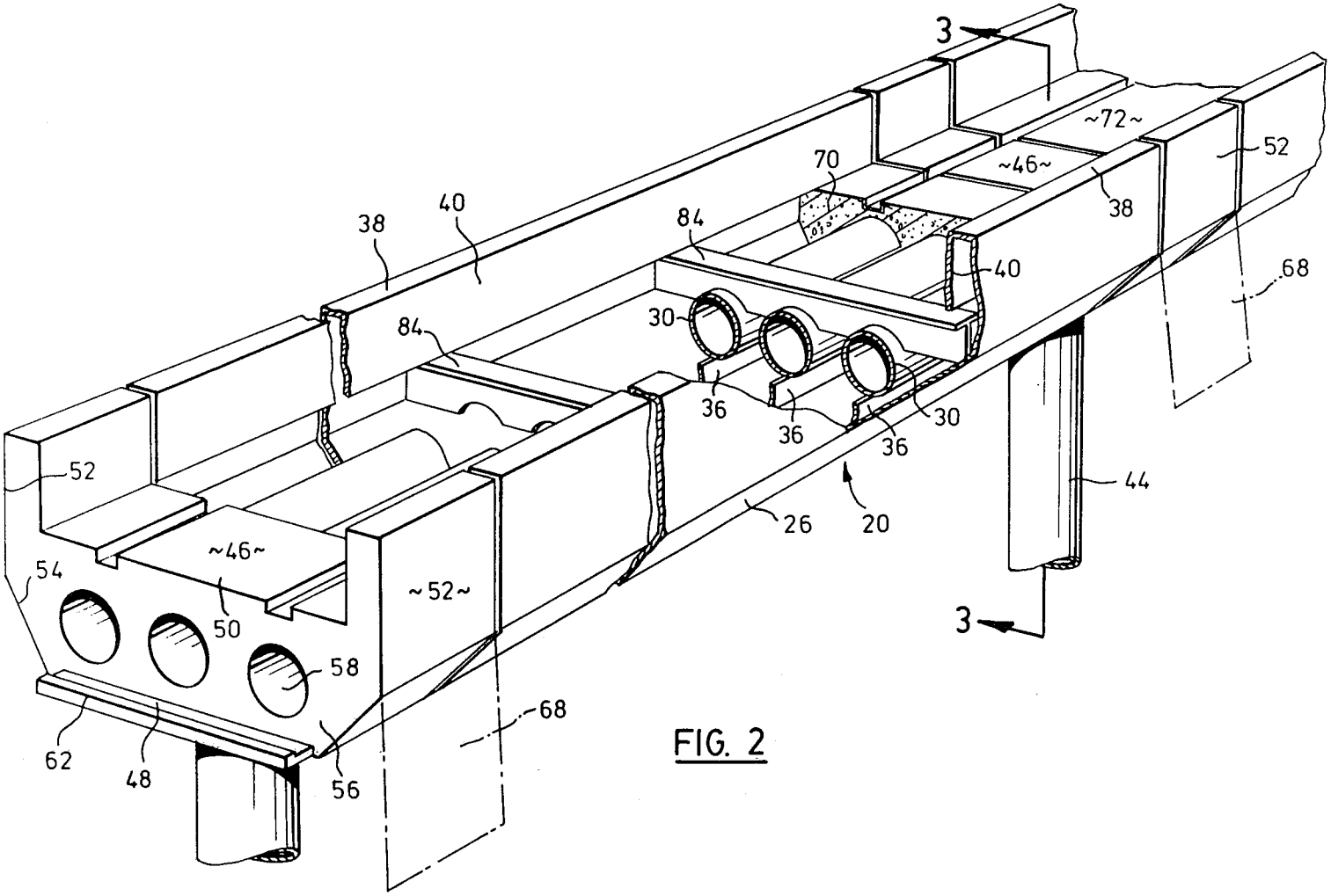
FIG. 2 is another perspective view showing part of the guideway with concrete in place and part without.
Figure 3:
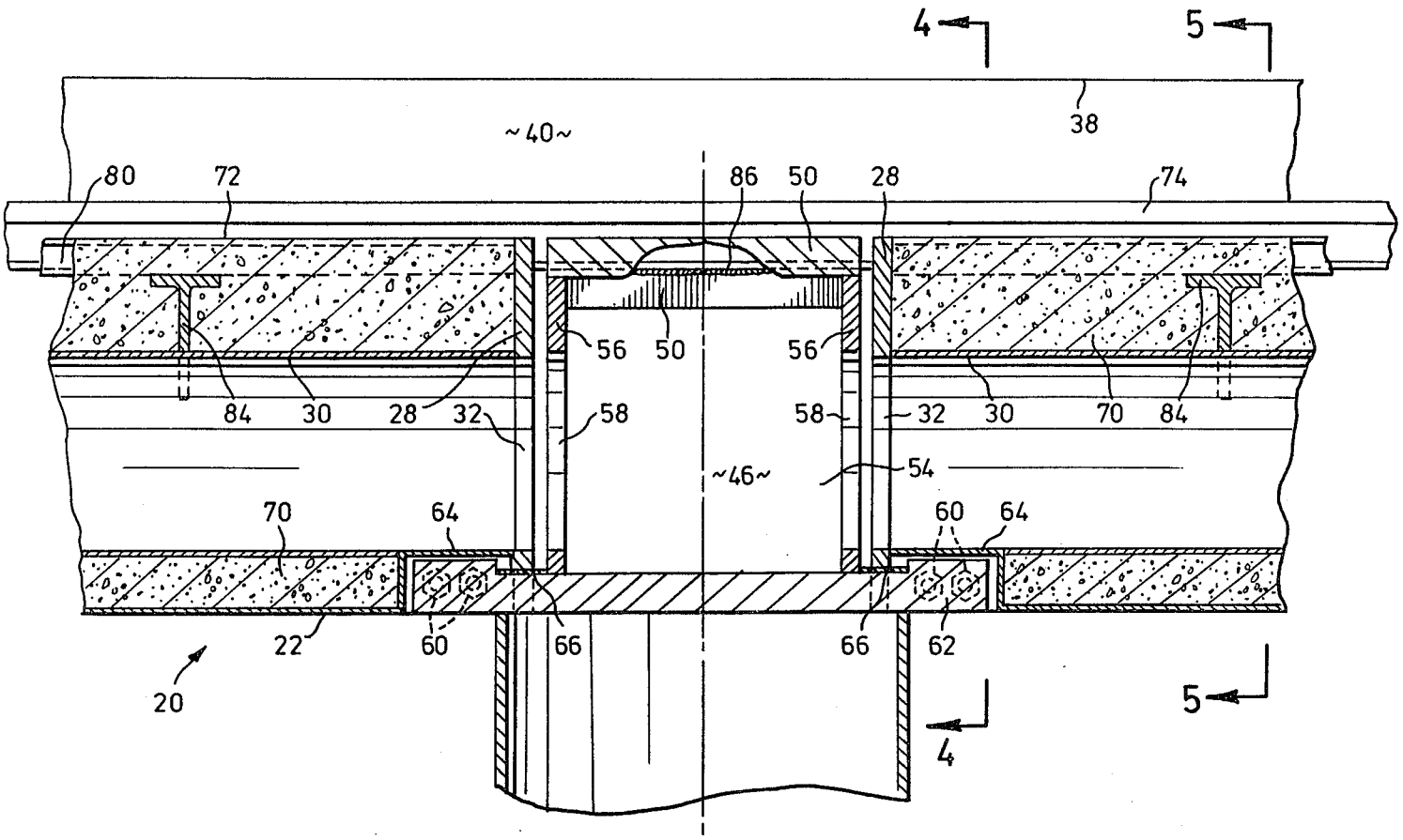
FIG. 3 is a cross-section taken on the line 3—3 of FIG. 2.
Figure 4:
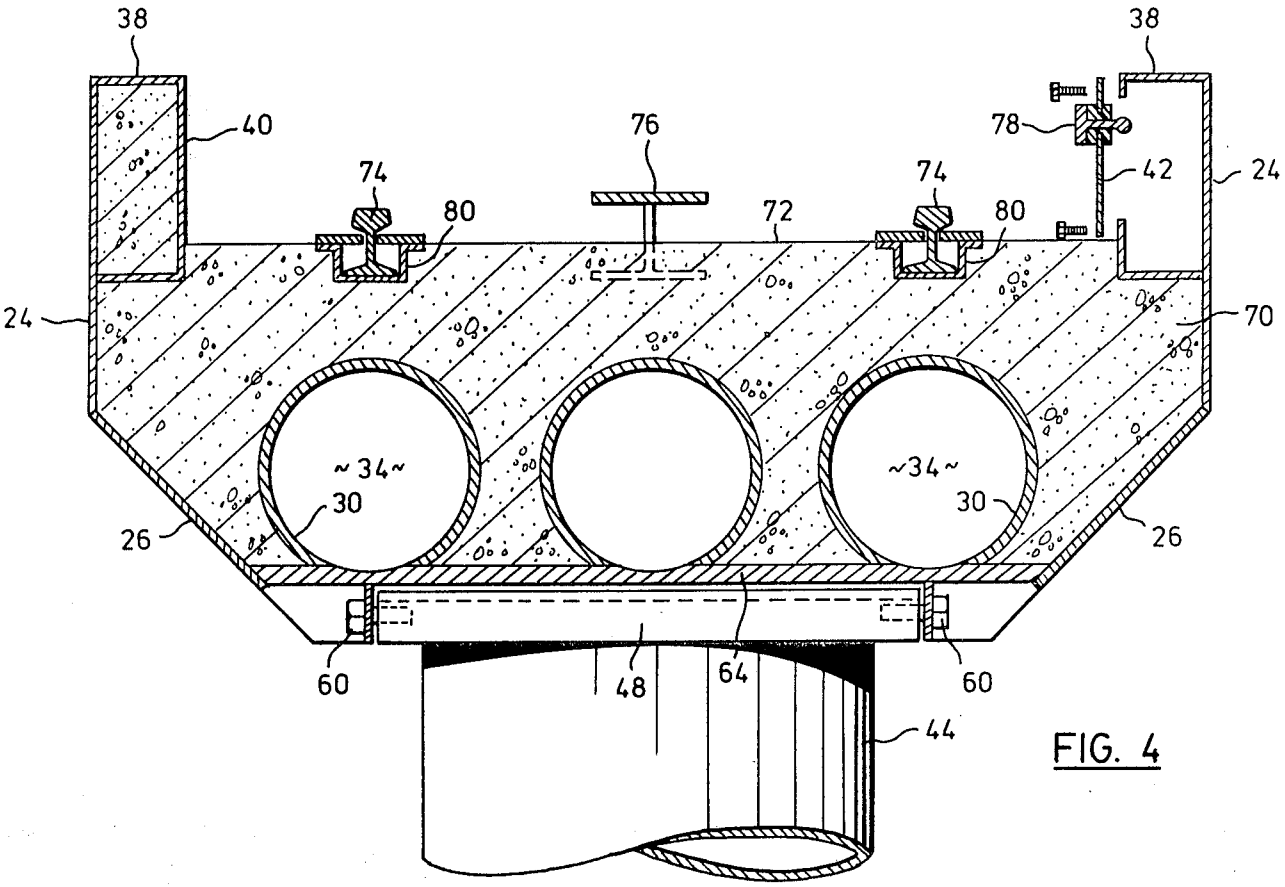
FIG. 4 is a cross-section taken on the line 4—4 of FIG. 3.
Figure 5:
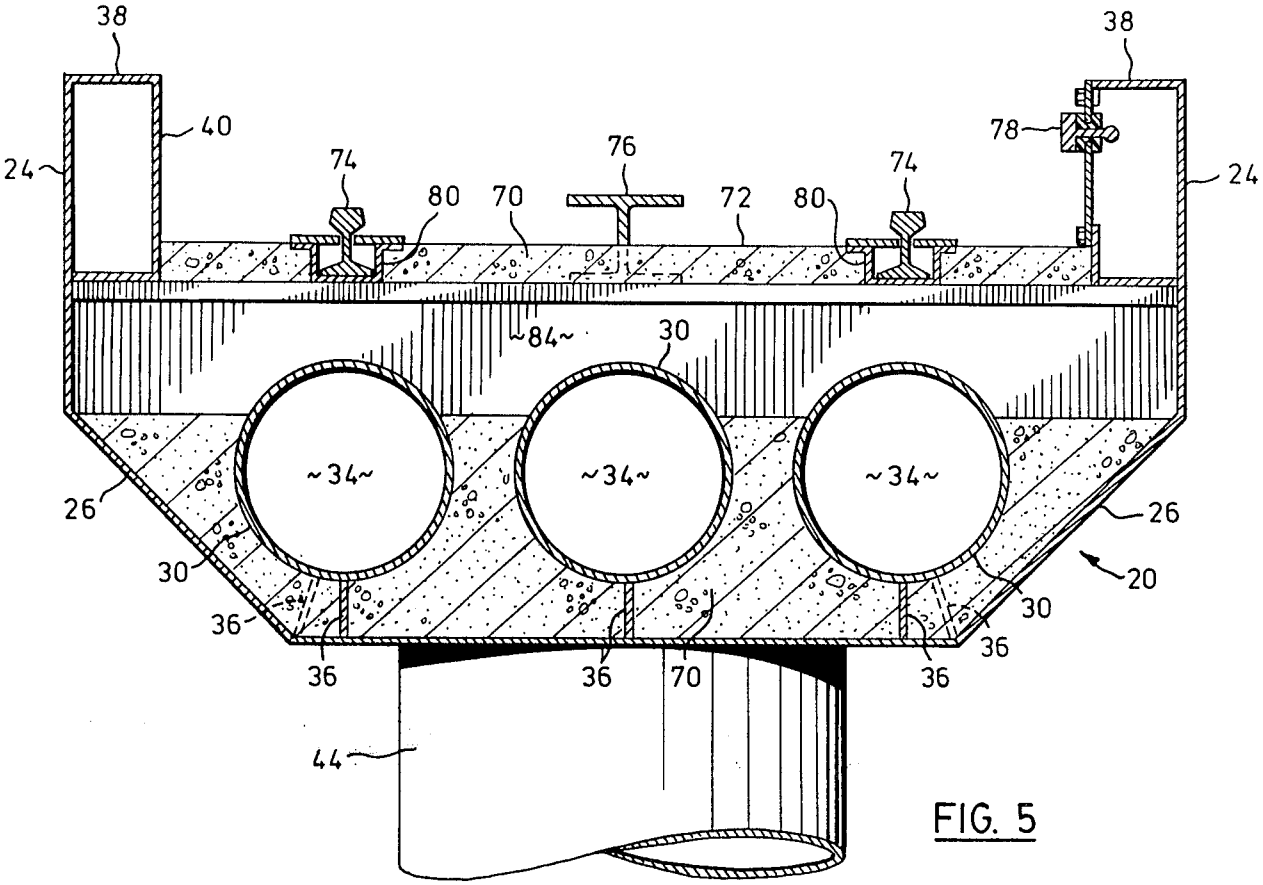
FIG. 5 is a cross-section taken on the line 5—5 of FIG. 3.

Referring now specifically to FIGS. 1 to 5, the guideway unit illustrated by these figures consists of an elongated metal channel 20 with closed ends, comprising a flat horizontal bottom sheet 22, vertical side sheets 24, upwardly-outwardly inclined side sheets 26 connecting together the bottom sheet and the respective vertical side sheet, and end closure sheets 28 (FIG. 3). This embodiment also comprises three like parallel elongated tubular hollow void-forming members 30 of circular cross-section extending the full length of the channel in its interior. Each void-forming member is fastened at its ends to the end sheets 28 which have apertures 32 therein registering with the bores 34 in the void-forming members, and is fastened along its entire length to the immediately adjacent channel interior wall by means of a respective longitudinally extending web member 36, which also spaces the void-forming member from the interior wall. In this embodiment the members 30 are each fastened to the channel by vertically disposed web members, but in other embodiments each of the two side members 30 may be connected to the junction of the bottom sheet and the respective inclined side sheet 26 (as indicated by broken lines in FIG. 5). The unit is provided with an integral parapet wall formed by the upper portions of vertical side sheets 24, and narrow horizontal top sheets 38 fastened to their top edges. The parapet may be completed by a fixed vertical sheet 40 parallel to the side sheet 24, or alternatively by a removable wall member 42 (FIG. 4) to provide access to the interior of the parapet wall, which can be used to carry services such as power and telephone cables for a railway system carried by the guideway.

In this particular embodiment a guideway structure of the invention is constituted by a plurality of the above-described guideway units mounted upon longitudinally-spaced cylindrical columns 44, although of course any other suitable form of supporting structure can be employed. Each column is provided at its upper end with a horizontal cross-head member 46 of transverse cross-section corresponding to that of the guideway units, each being hollow and formed by a bottom plate 48, top plate 50, side plates 52 and 54 and end plates 56, the plates 56 being provided with apertures 58 that register with the apertures 32 in the end plates 28 and the bores 34 in the tubular members 30. The column may be provided with an access door 59.

The open-topped, closed-end channel formed by each guideway unit is hoisted into position and mounted on the two cross-head members 46 by which it is supported, and has its ends fastened thereto by any suitable means, such as transverse bolts 60. It will be noted from FIG. 3 that a space is left between each end sheet 28 of the guideway unit and the respective cross-head end plate 56, so as to make provision for expansion and contraction of the guideway unit with ambient temperature changes. In this embodiment each cross-head bottom plate 48 is provided with a transverse ridge 62, while the adjacent end of the guideway is provided with a horizontal closure plate 64. The bearing bottom edge member 28 slides upon a low-friction pad 66. The gap between each guideway unit end and its abutting cross-head can be filled by means of a flexible seal, so as to accommodate changes in the gap width. The cross-head member is also provided with an access door 68.

The guideway unit is now completely filled with settable material such as concrete 70 to a level such that its upper surface 72 at least just encloses the bottom edges of the vertical sheets 40. Care is taken in pouring this concrete that it enters the space between the void-forming members 30 and the bottom sheet 22 and the side sheets 24 and 26, so that all of the space in the channel is completely filled with concrete except for the voids provided by the members 30. The concrete is suitably compacted in known manner and the top surface is smoothed so as to provide a smooth road bed on which rapid transit vehicles can run. A layer of mesh can be used at the top surface to control cracking but is not illustrated; alternatively or in addition a fibre reinforced concrete can be used. A rubber-tired vehicle can run directly on the surface provided by the concrete and any side-guiding wheels which it may employ can engage the vertical sheets 40, which can also have facing plates of more rigid material fastened thereto to prevent excessive wear by the contact with such edge-guiding wheels. It may be desirable in such circumstances also to fill the space between vertical sheet 40 and side sheet 24 with more concrete so that a solid structure is achieved, although such an arrangement is not specifically illustrated in the drawing.

The embodiment of FIGS. 1 to 5 is illustrated as supporting a railway system of the type employing steel running rails 74, a central support 76 for a linear induction motor assembly and a power collector rail 78 mounted on removable side panels 42. The rails 74 and support 76 are mounted in respective metal channel members 80 which are embedded in the concrete, with the bottom cross webs of the channels sitting on the cross-bar members of a number of longitudinally spaced T cross-section transverse web memers 84, the feet of these web members being fastened to the adjacent surfaces of the tubular members 30, as by welding, the feet being shaped to conform to the circular outer surface. The transverse members 84 are also welded to the parapet member (i.e. vertical sheet) 40 and/or side sheet 24 to provide lateeral restraint therefor. The parapets may in some embodiments also be filled with concrete. The rails can of course be mounted on the concrete top surface 72 without the use of the channel members 80. Each rail 74 is rigidly fastened as by welding at 86 (FIG. 3) to the cross-head top plate 50 so as to be rigidly connected to the column members; this arrangement permits continuous rails to be used without the danger of the production of an excessively large gap if the rail should break because of contraction, since such a gap will be the result of contraction only of the length of rail between the two adjacent cross-heads. In the event of rail failure the concrete filled guideway unit will act as a tension tie member to prevent the production of a large gap.

It will be seen that a guideway unit of the invention is a composite longitudinally-voided structural beam using steel and concrete, or other suitable materials. All the metal elements of the guideway unit are fastened together usually by welding to provide an integral construction. The units may be shop prefabricated under controlled conditions, and a maximum number of attachments for the transit system will also be applied during this prefabrication. Each unit can be made to span 30 to 45 meters (100 to 150 feet) between supports, and yet is relatively light in weight before the concrete has been poured (e.g. about 25% of the weight of an equivalent precast concrete section) for ease in handling and hoisting. The unit is used as its own permanent formwork to support the load of the wet concrete and construction loads (e.g. the workers can walk around on the structure), the void-producing members providing torsional stability to the steel structure. No shoring is therefore required and there is therefore a minimum of interference with traffic during installation. The unit channel is watertight so that the concrete strength will be optimized because of complete hydration of the cement by the retained water; shrinkage of the concrete with consequent cracking and deflection are thus also minimized.

After the concrete has set the lower part of the steel section provides the tensile stress reinforcement for the resultant composite slab to support super-imposed loads due to vehicles, wind, snow and ice, earthquake, etc., such a composite beam providing maximum strength and stiffness with a minimum depth, thereby reducing visual obstruction and interference with existing conditions when installed. The internal voids created by the tubular members 30 reduce the dead load of the concrete fill and provide a convenient passageway for services such as gas, electricity, telephone, street lighting, water, etc. Creep, and hence long term deflection, is minimized since the entire dead load of the concrete is supported by the steel section leaving the concrete without any sustained dead load stress. Sound transmission through the guideway beam is minimized due to the complete encasement of the voids with concrete and due to the relatively thick layer of concrete located below the running rails of the transit system. Torsional stiffness of the composite beam will be great, due to the complete encasement of the voids with concrete.

After the concrete sets the desired composite action is achieved by a combination of the following factors:

(1) Chemical bonding between the concrete and the steel.

(2) Mechanical bonding due to the concrete encasement of the void-producing members which are considered as hollow reinforcing bars.

(3) Mechanical bonding due to the concrete encasement of the longitudinal and transverse shear members.

An attractive, elegant, streamline and modern-looking structure is provided as a result of the smooth surfaces, sloping sides, shallow depth and also due to the use of a single exposed material, namely the steel.

A very important feature of the trackway is the excellent aesthetic appearance provided by the smooth walled sides and the streamlined shape which besides being aesthetically pleasing should be of assistance in giving streamlining against windage. These inclined sides of these embodiments also insure that as little as possible of the concrete is required, eliminating the need for concrete at a place where it would add minimum strength to the structure, while at the same time reducing the dead load of the concrete in question. Steel sections made of weathering steel will provide an attractive dark brown, maintenance-free structure, and if required, a painted surface can be shop applied to any desired colour, including black, using a long-lasting coal-tar epoxy finish. The metal side walls provide an additional degree of safety in the event of vehicle derailment and, during construction, provide a partial height guardrail to which temporary and moveable guardrail sections can be attached to provide the required height for adequate protection of workers on the guideway. Moreover, the side walls effectively conceal the wheels and undercarriages of the transit cars to make the transit system more attractive.

The void-producing members illustrated are round steel pipes but other shapes can also be used such as hexagonal, octagonal, square, etc. It is used as the compression flange of the steel section and after setting of the concrete it is used as part of the tensile stress reinforcement for the resultant composite beam structure. The longitudinal web member, if used, is a flat steel plate and provides a means to increase the depth of the steel section to increase the stiffness and strength and also, after the concrete sets, to provide part of the tensile stress reinforcement for the resultant composite beam structure. The bottom sheet member 22 will usually be a flat steel plate or a corrugated steel section with corrugations parallel to the voided member. The transverse members are used to increase the stability of the steel section during fabrication, transportation, erection and during concrete pouring, and also, are used to provide a mechanical shear connection between the steel and concrete. They may be flat steel plate or any other shape in place of the T cross section members illustrated. The vertically placed flat steel will provide horizontal shear connection and the T-shape member will provide vertical, as well as horizontal, shear connection between the concrete and steel.

Figure 6:
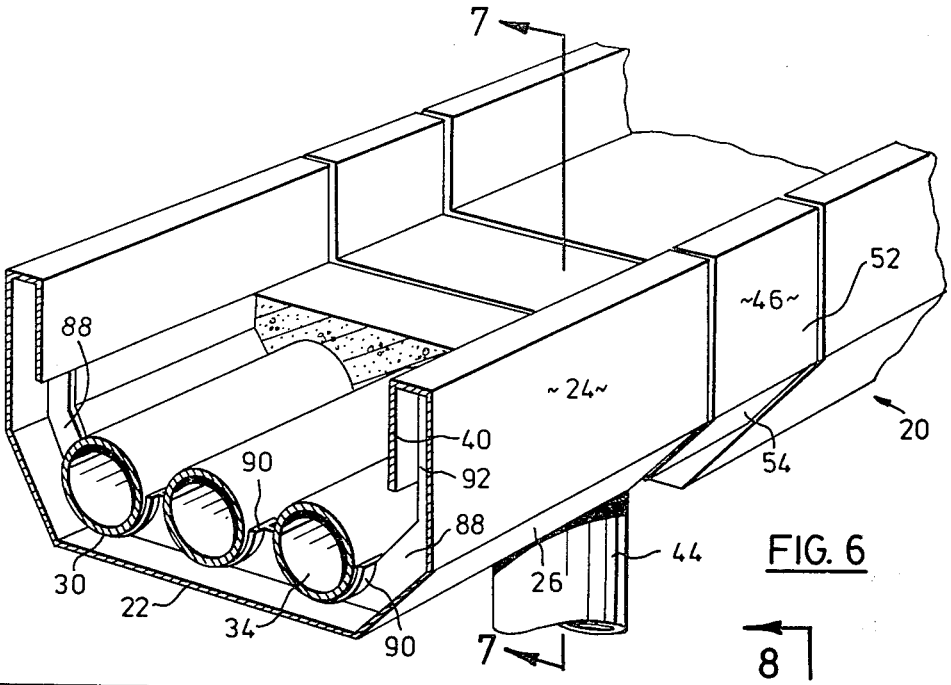
FIG. 6 is a perspective view similar to FIG. 2 of a second embodiment.
Figure 7:
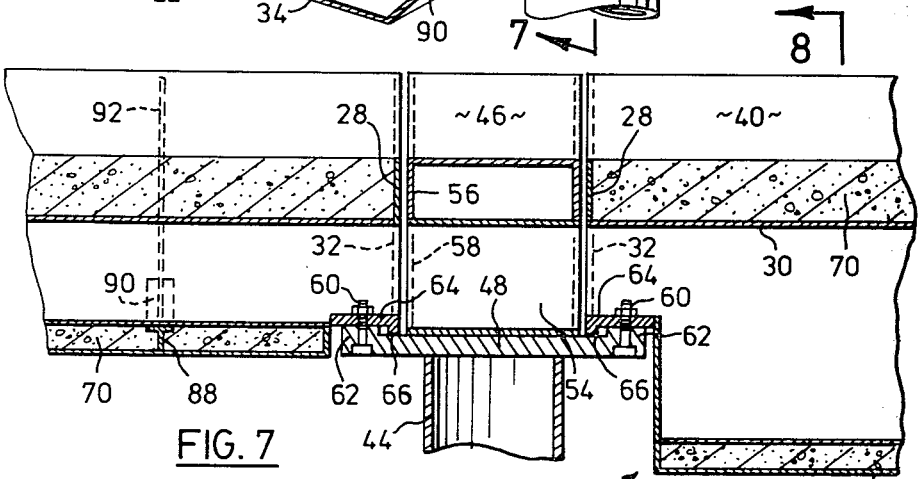
FIG. 7 is a cross-section taken on the line 7—7 of FIG. 6.
Figure 8:
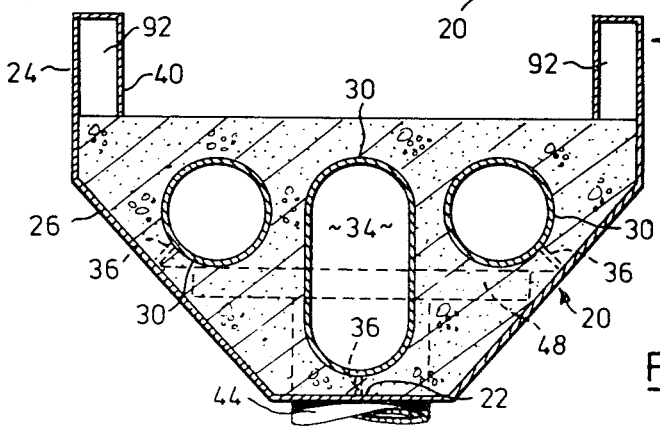
FIG. 8 is a cross-section taken on the line 8—8 of FIG. 7.

FIGS. 6 to 8 of the drawing show the cross section of another guideway unit in which the tubular void-producing members 30 are spaced from the channel walls and connected thereto, by a plurality of longitudinally spaced transverse web shear members 88 which are fastened to the inside walls of the channel and also to the members 30 via intervening saddle members 90.

It will be noted that upper ends 92 of the members extend between the parapet walls (i.e. side and vertical sheets) 24 and 40 and serve as reinforcements therefor. Such transverse members may be used in a guideway unit of the invention in addition to the longitudinal web shear members in some circumstances. Such transverse members may also be used to pre-determine the cracking pattern of the lower part of the concrete. Thus, when the resultant composite beam structure is loaded some of the concrete at mid-span, or in other areas where the bending moment and flexural stresses are greatest, may crack due to excessive tensile stresses. The tensile failure of concrete is usually sudden, which could cause excessive propagation of the crack upwards and result in a weakening of the composite slab. The transverse plates will preform cracks and can prevent excessive cracking, the height of the transverse members being varied to suit the tensile stress pattern, the height increasing to a maximum at the centre. Near the ends of the span, where tensile failure is unlikely to occur, the transverse members are of minimum height and will act as horizontal shear connectors between the concrete and steel.

FIGS. 6 to 8 also show a construction with which a much greater span can be achieved by use of a guideway unit of the invention, the vertical cross-section of the unit being much increased, with the result that the bottom sheet 22 is of smaller width, while the two inclined side sheets 26 are of much longer widths. Moreover, the center one of the ducts 30 now has an oval cross-section, with the major axis of the oval disposed vertically. FIG. 7 shows in transverse cross-section a guideway unit of smaller depth joined by the intervening junction cross head member 46 to a guideway unit of much greater depth. The two units are functionally exactly the same.

Figure 9:
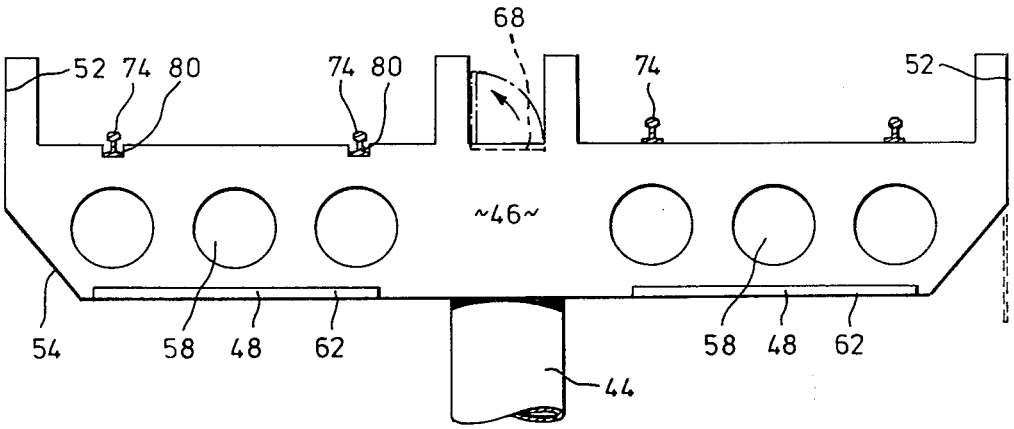
FIG. 9 is a side elevation of a double guideway support structure to illustrate the general arrangement of such a structure.

FIG. 9 shows one way in which a single support structure is arranged to accommodate two parallel guideways for a transit system. For the purpose of illustration the rails 74 on one side are shown mounted in channels 80, while the rails on the other side are mounted directly on the cement surface.

Figure 10:
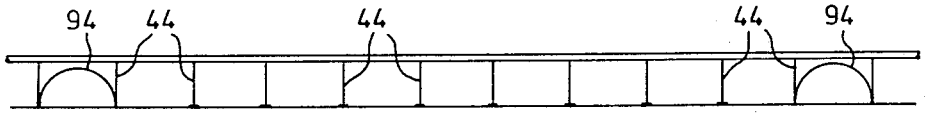
FIG. 10 is a side elevation of a length of guideway over a number of sections thereof to illustrate a feature of construction.

FIG. 10 shows in side elevation a considerable length of the guideway (e.g. about 330 meters) involving 12 vertical support columns 44. It is found desirable at about this interval to provide a rigid connection 94 between two immediately succeeding columns 44, whereby the columns are rigidly connected together to form a rigid frame providing longitudinal support against forces in the rail caused by temperature changes thereof. The rigidity of the columns can of course be increased by filling them with concrete in locations where access to the interior is not required. The connection can have the form of an arch so as to have an aesthetically-pleasing appearance. Such rigid frames are also desirable at the beginning and end of a curve in the system to provide the necessary support at such locations. and also to eliminate the need for the support columns in between the rigid frames to be designed to withstand longitudinal forces, such as thermal rail forces and those produced by vehicle acceleration and braking.

By way of example only, the following dimensions are considered suitable for a guideway proposed for use with a lightweight rapid transit rail system:

| | | |
|---|---|---|
| Span of guideway: | 30 meters | (100 feet) |
| Width of guideway: | 3 meters | (10 feet) |
| Overall depth of guideway: | 1.5 meters | (5.0 feet) |
| Thickness of bottom plate 22: | 1.25 cm. | (0.5 ins.) |
| Thickness of side plates 24 & 26: | 0.95 cm. | (0.37 ins.) |
| Thickness of top plate 38: | 2.5 cm. | (1 ins.) |
| Thickness of end plate 28: | 1.9 cm. | (0.75 ins.) |

-continued

| | | |
|---|---|---|
| Diameter of members 30: | 61 cm. | (2 feet) |
| Wall thickness of members 30: | 0.625 cm. | (0.25 ins.) |
| Thickness of webs 36: | 0.95 cm. | (0.37 ins.) |
| Thickness of T webs: | 0.95 cm. | (0.37 ins.) |
| Thickness of cross head plate 48: | 5.0 cm. | (2 ins.) |
| Thickness of cross head plate 50: | 2.5 cm. | (1 ins.) |
| Diameter of column 44: | 122 cm. | (4 feet) |
| Wall thickness of column 44: | 1.9 cm. | (0.75 ins.) |

In all of the embodiments illustrated the channel is formed of vertical side plates, inclined side plates and a bottom plate, these plates being connected together at their longitudinal adjoining edges by continuous longitudinal welds. Such a cross-section has particular utility as explained above, but other cross-sections may be employed. In particular it may be possible to bend sheets of the necessary thickness to the shape required avoiding the need for some of the welding; in such circumstances there may not be any specific line of demarcation between the bottom wall member and the side wall members and they may simply merge into one another. It may also be more economical to fabricate the channel from unitary members bent to the requisite cross-section and fastened together end-to-end by transverse welds.

I claim:

1. A guideway unit for use in combination with a settable material in the construction of an elevated guideway, the unit comprising:

an elongated closed end watertight metal channel constituted by a bottom metal wall member, spaced side metal wall members, and end metal wall members closing the respective ends of the channel for the retention of settable material therein, the said channel having respective interior walls provided by the said wall members;

at least one elongated metal hollow tubular void-forming member extending the length of the channel in the interior thereof, and connected at its respective ends to the end metal wall members so as to constitute longitudinal reinforcement for the channel, each hollow void-forming member being spaced from the channel interior walls and being connected to a channel interior wall along its length by at least one longitudinal web member fastened to the tubular member external wall and to the respective channel interior wall;

and set settable material filling the metal channel and surrounding each hollow void-forming member and the respective longitudinal web member so as to enclose them;

the metal channel constituting permanent formwork for the settable material and together with the set settable material constituting a composite slab with composite action between the channel and the set settable material, the metal tubular void-forming members providing tension reinforcement for the composite slab; and the set settable material having an upper surface capable of providing or supporting a roadway for vehicles moving on the guideway.

2. A guideway unit as claimed in claim 1 wherein each metal hollow tubular void-forming member is also connected to the channel interior walls by a plurality of longitudinally-spaced transverse metal web members disposed above the void-forming members and each fastened to the tubular member external wall and to the channel interior walls, the said transverse metal web members also being surrounded by set settable material to be enclosed therein.

3. A guideway unit as claimed in claim 1, and including three transversely-spaced parallel tubular void-forming members each connected to a respective one of the said channel interior walls by a respective longitudinal web member fastened to the tubular member external wall and to the respective channel interior wall.

4. A guideway unit as claimed in claim 3, wherein the center one of the said transversely-spaced metal tubular void-forming members is of deeper cross-section than the two side members.

5. A guideway unit as claimed in any one of claims 1, 2, 3 or 4, wherein each metal side wall member of the channel extends above the said upper surface of the unit provided by the set settable material and there is provided another wall member spaced inwardly therefrom and connected thereto to provide a respective integral parapet extending along the edge of the guideway above the said upper surface.

6. A guideway unit as claimed in any one of claims 1, 2, 3 or 4, wherein each metal side wall member comprises a vertical side wall portion and an inwardly inclined side wall portion connecting the said vertical side wall portion and the bottom wall member so as to reduce correspondingly the quantity of set settable material required to fill the metal channel.

7. A guideway unit as claimed in claim 1, in combination with a pair of spaced vertical-extending support structures on which its ends rest so as to be supported thereby elevated above grade, wherein each support structure includes a crosshead on which the immediately adjacent ends of the two associated guideway units rest, and wherein the crosshead is provided with openings extending longitudinally therethrough and registering with the ducts in the interiors of the tubular void-forming members in the two associated guideway units so as to provide a continuous passageway between the said ducts of the two associated guideway units.

8. A guideway unit as claimed in claim 7, wherein the crosshead is provided with a door for access to the interiors of the ducts of the said associated guideway units.

9. A guideway unit as claimed in claim 7 or 8, wherein the guideway supports on the said upper surface of the set settable material a railway track having rails that extend continuously over a plurality of guideway units, and wherein each rail is fastened to each vertically-extending support structure against longitudinal movement relative thereto.

* * * * *